US006091392A

United States Patent [19]

Imamura

[11] Patent Number: 6,091,392

[45] Date of Patent: Jul. 18, 2000

[54] PASSIVE MATRIX LCD WITH DRIVE CIRCUITS AT BOTH ENDS OF THE SCAN ELECTRODE APPLYING EQUAL AMPLITUDE VOLTAGE WAVEFORMS SIMULTANEOUSLY TO EACH END

[75] Inventor: Yoichi Imamura, Suwa, Japan

[73] Assignee: Seiko Epson Corporation, Tokyo, Japan

[21] Appl. No.: 08/026,234

[22] Filed: Mar. 2, 1993

Related U.S. Application Data

[63] Continuation of application No. 07/783,728, Oct. 28, 1991, abandoned, which is a continuation of application No. 07/391,593, Jul. 10, 1989, abandoned.

[30] Foreign Application Priority Data

| | | | |
|---|---|---|---|
| Nov. 10, 1987 | [JP] | Japan | 62-284025 |
| Oct. 27, 1988 | [JP] | Japan | 63-271229 |
| Nov. 9, 1988 | [WO] | WIPO | PCT/JP88/01126 |

[51] Int. Cl.[7] ..... G09G 3/36; G09G 5/00

[52] U.S. Cl. ..... 345/100; 345/94; 345/204

[58] Field of Search ..... 345/211–214, 90, 345/87, 92, 93, 94, 97, 98, 99, 100, 204, 205, 206, 208; 359/85, 59

[56] References Cited

U.S. PATENT DOCUMENTS

| | | | |
|---|---|---|---|
| 4,346,378 | 8/1982 | Shanks | 345/98 |
| 4,427,997 | 1/1984 | Hareng et al. | 345/87 |
| 4,789,857 | 12/1988 | Maurice | 345/93 |
| 4,803,480 | 2/1989 | Soneda et al. | 345/100 |

FOREIGN PATENT DOCUMENTS

| | | |
|---|---|---|
| 0 197 551 | 10/1986 | European Pat. Off. . |
| 0 260 747 | 3/1988 | European Pat. Off. . |
| 36 30 012 | 4/1987 | Germany . |
| 2 081 018 | 2/1982 | United Kingdom . |
| 2 183 054 | 5/1987 | United Kingdom . |

*Primary Examiner*—Jeffery Brier
*Assistant Examiner*—Paul A. Bell
*Attorney, Agent, or Firm*—Stroock & Stroock & Lavan LLP

[57] ABSTRACT

The present invention is directed to a flat display device and the driving method thereof having a plurality of display picture elements which are defined by liquid crystal cell portions formed between the scanning and the signal electrodes arranged in the form of a matrix wherein at least scanning electrodes of said scanning and signal electrodes are driven from both terminals of the electrodes by individual driving circuits. A circuit is also included that creates a short circuit across the electrode thus protecting the flat display panel from degradation due to excessive current flowing across the panel before the voltage waveform is stabilized.

14 Claims, 3 Drawing Sheets

PASSIVE MATRIX LCD WITH DRIVE CIRCUITS AT BOTH ENDS OF THE SCAN ELECTRODE APPLYING EQUAL AMPLITUDE VOLTAGE WAVEFORMS SIMULTANEOUSLY TO EACH END

This is a continuation of application Serial No. 07/783,728, filed Oct. 28, 1991, now abandoned which, is a continuation of application Ser. No. 07/391,593, filed on Jul. 10, 1989, for FLAT DISPLAY DEVICE AND METHOD OF DRIVING THE SAME, and now abandoned.

BACKGROUND OF THE INVENTION

This invention relates to a flat liquid crystal display device, and more particularly to a flat display device having a plurality of display elements which are defined by liquid crystal cell portions formed between the scanning and the signal electrodes arranged in the form of a matrix and the method of driving the flat display device. In particular, the present invention-relates to a driving method which is effective for the improvement of the display quality in the flat display device.

One method for driving a flat display panel is shown in Japanese Patent Laid-Open No. 38935/78 and Japanese Patent Laid-Open No. 52686/83. This method discloses a driving circuit connected to one end of transparent electrodes in order to drive a display panel.

However, in the above-mentioned prior art, since large capacity dot matrix type liquid crystal panels are required in many applications, the transparent electrodes increase in length and width. The electrode resistance, R, and capacitance, C, across the terminal of the driving circuit to the end of the electrode increases. This increase results in degradation of the display. For example, when the liquid crystal panel has 640×400 dots and is driven at a duty ratio of 1/200, R=10~60 KΩ, and C=800~2000 pF.

When the driving waveform changes, there is a delay period of up to several tens of $\mu$sec. in which the display elements stabilize. This delay time is significant relative to one scanning period (60~80 $\mu$s). Due to the delay time, the effective driving voltage applied to the respective display elements varies during stabilization from the predetermined value obtained by the voltage standard method. As a result, unevenness of color contrast occurs, as shown in FIG. 2. The quality of the display is reduced so much that it may be difficult to distinguish the non-selected and selected regions.

FIG. 2 shows one embodiment of the prior art wherein unevenness of color contrast is generated between the non-selected regions 11 and 12 when every other horizontal lines is ON. As shown in the upper side of the portion 11, when there are a large number of signal electrodes 14 and every other horizontal line is in the ON state, the display is too light. In the upper side of the portion 12, when there are fewer signal electrodes 15 and every other horizontal line is in the ON state, the display is too dark. The color contrast is likely to be more even when the resistance of the scanning electrodes is high.

Increasing the thickness of the electrodes in order to reduce the resistance is ineffectual because of the inferior alignment and increased cost of the panel due to the reduction of the throughput in the manufacturing. Therefore, there is a limit to the thickness of the transparent electrodes that can be achieved.

In order to eliminate the above problems, the object of the present invention is to drive the electrodes of the liquid crystal panel from both terminals thereof, thereby providing a flat display device possessing a high quality display and little unevenness of contrast.

SUMMARY OF THE INVENTION

The flat display device and method of driving the same according to the present invention has a construction in which the scanning and signal electrodes are arranged in the form of a matrix. Display elements are formed at the crossing points therebetween. The scanning electrodes are driven from both terminals of the electrodes by driving circuits.

According to the above method of the present invention, the resistance of the transparent electrodes becomes approximately one quarter the resistance of the transparent electrodes when the electrodes are driven from only one side. The output resistance of the driving circuit become equivalently one half and the effect of the voltage variation of the display elements is also less because the electrode is being driven from both terminals. Therefore, elements are not likely to be affected by the varying voltage, so that the quality of display is improved over that of the prior art.

Accordingly, it is an object of this invention to provide an improved flat display device which substantially reduces contrast problems.

It is another object of the invention to provide an improved flat display device which applies a voltage to both scanning driving circuits to prevent current from flowing across the liquid crystal.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
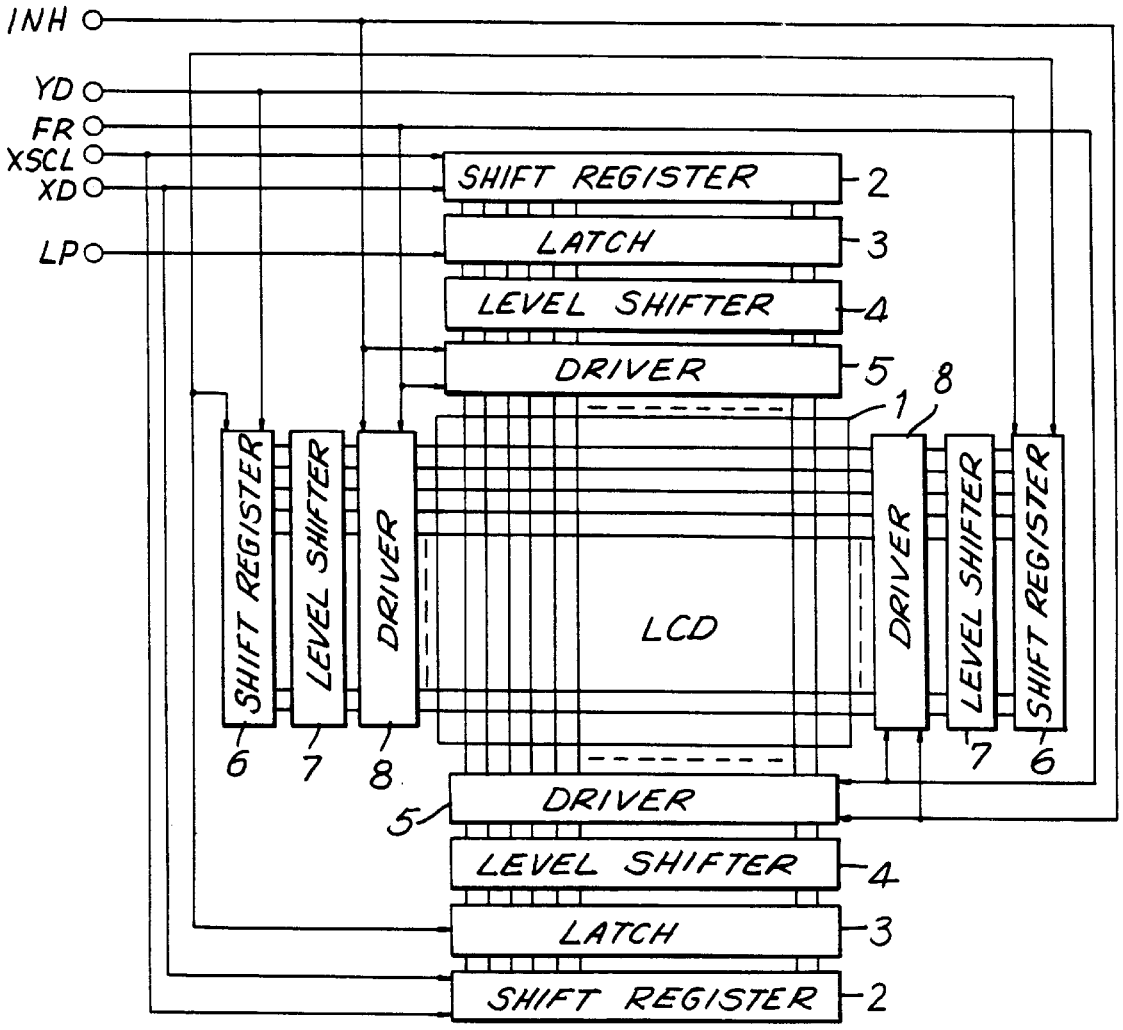
FIG. 1 is a perspective view of the flat display device in accordance with the present invention.

FIG. 1 shows a driving method according to one embodiment of the present invention. The display elements are formed on the crossing portions between the scanning and signal electrodes, arranged in the form of a matrix. The flat display device is driven by two segment and scanning side driving circuits of the transparent electrode (i.e. ITO (Indium Tin Oxide)). The amplitudes of the voltages simultaneously applied to the both ends of the scanning and signal side driving circuits are equal. A shift clock input, XSCL, is input to a shift register 2. In addition, the display data, XD, is switched in parallel into shift register 2. Shift clock input, XSCL, is synchronized with a latch signal, LP, by a latch 3, and display data, XD, is converted through a level shifter 4 and driver 5 to a liquid crystal driving waveform having an amplitude equal to one of four voltage levels employed in the voltage standard method to either activate or deactivate each display element.

FIG. 1 also illustrates the functioning of the scanning driving circuits. A shift register 6 receives a start pulse, YD, and latch signal, LP. The output of shift register 6 is converted to a liquid crystal driving waveform by a level shifter 7 and a driver 8.

When power is applied to the flat display device (i.e. power-on), the circuits become unstable, and the output voltages of the two driving circuits which are connected to each other through a transparent electrode are not equal. Since the liquid crystal driving voltage is 20–40 V, a current of several hundred $\mu$A–several mA is applied across each electrode during each output period. This amount of current causes degradation of the driving circuit and liquid crystal panel. Therefore a driving circuit is provided to control the output for a predetermined time until the waveform of the driving circuit is stabilized by a prohibit signal, INH, at the time of power-on in order to create a short circuit across the liquid crystal panel.

Figure 3:
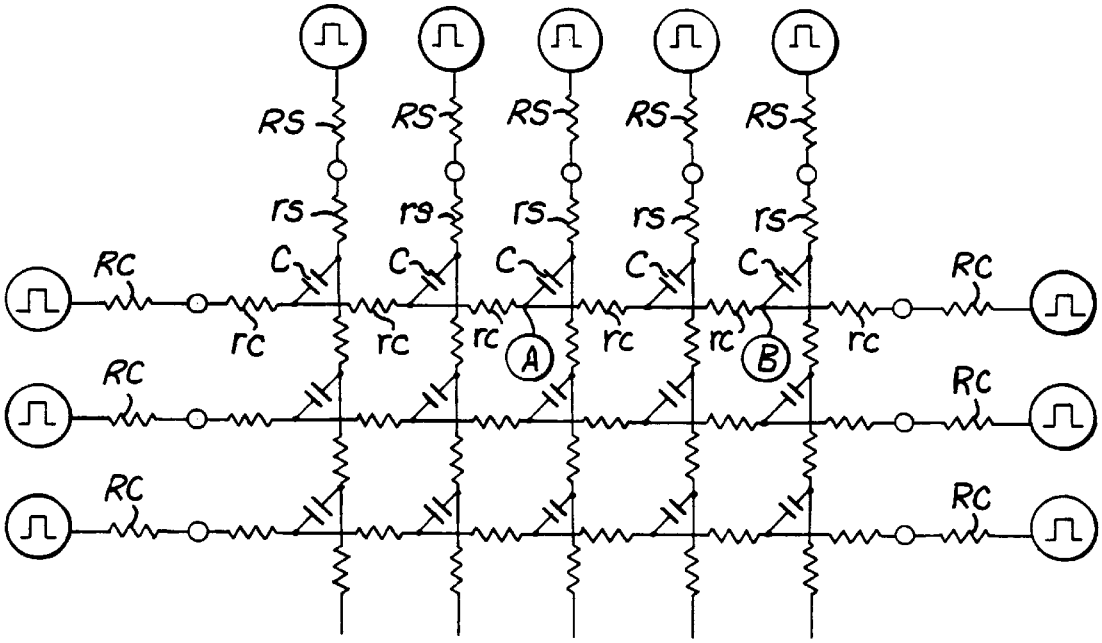
FIG. 3 is a schematic showing an electronic model of the flat display of FIG. 1.

FIG. 3 is an electronic model of the driving circuit according to a dot matrix flat display device of the present invention. In FIG. 3, 5×3 matrix panel is driven from both terminals of the scanning electrodes. Display element A signifies the display element farthest from either terminal of a scanning electrode driven by a dual driving mechanism in accordance with the present invention. Display element B represents the display element farthest from the terminals of a scanning electrode driven by a single driving circuit in accordance with the prior art.

Resistance values between the driving circuit and the portions A and B are as follows:

Ⓐ: $(3r_c+R_c)\times\frac{1}{2}\Omega$

Ⓑ: $5r_c+R_c\Omega$

Herein, $r_c$ and $r_s$ are the resistance between display elements, and $R_c$ and $R_s$ are the output resistances of the driving circuits. $R_c$ is greater than or equal to 1 KΩ. When the number of display elements is increased, $r_c$ increases to several hundred or more KΩ and the value of $R_c$ becomes negligible. Therefore, when the number of display elements is increased, the resistance ratio Ⓐ:Ⓑ approaches 1:4. Since the capacitor, C, coupled to the electrodes is not changed, the display quality obtained according to the driving method of the present invention is the same as that of the prior driving method while the resistance of the transparent electrodes is reduced to one quarter. Since the display quality of the present invention is the same as that of the prior art, a liquid crystal cell having twice as many display elements can be realized while preserving the high resolution of the flat display.

Figure 4:
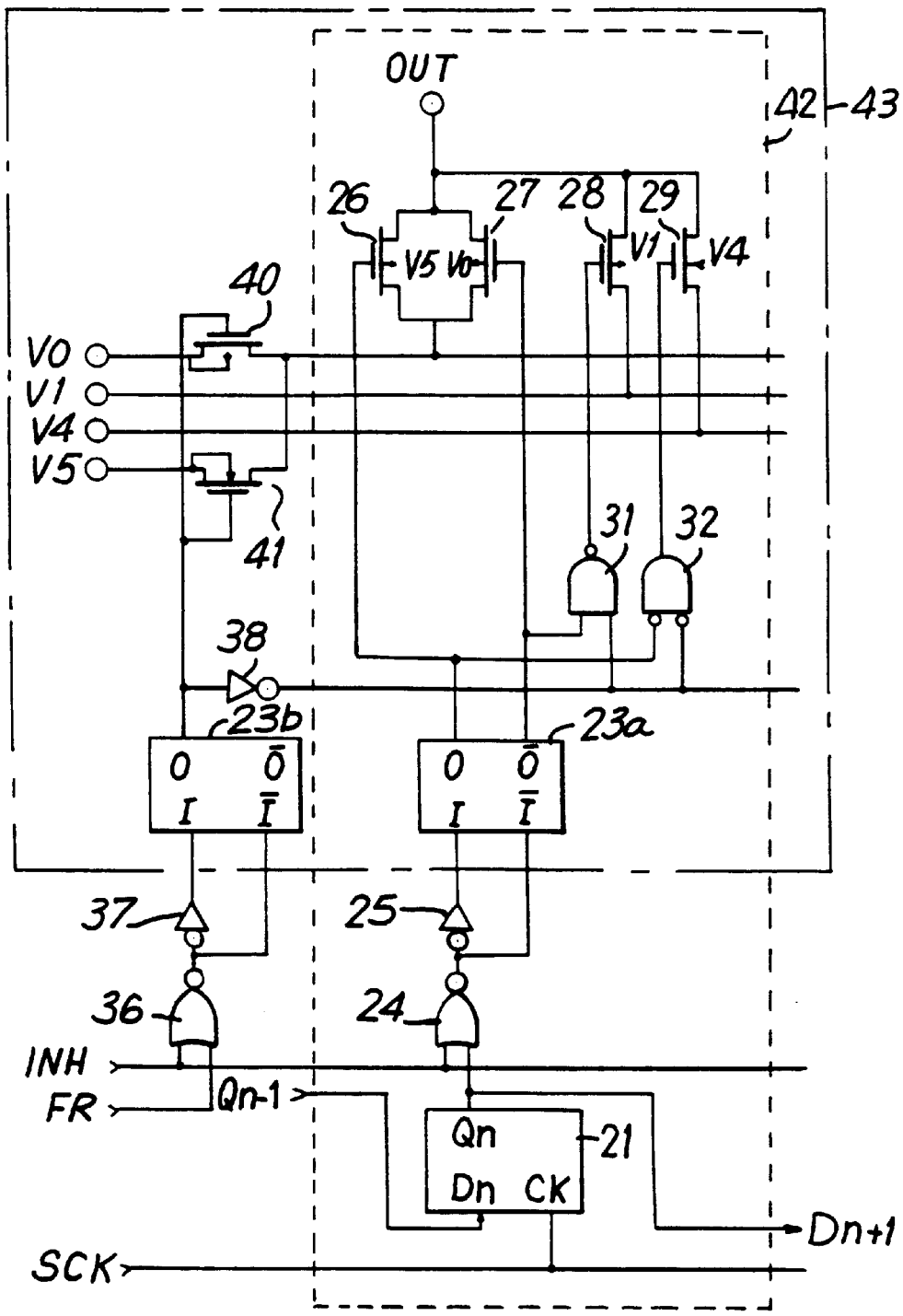
FIG. 4 is a circuit diagram of the driving circuit utilizing short preventing circuitry in accordance with the present invention.

FIG. 4 shows one embodiment of the scanning driving circuit. The circuitry which is surrounded by a dotted line 42 shows the driving circuits for one scanning electrode. Two circuits are utilized for each electrode. Each circuit is coupled to the next and previous electrode circuits. The portion surrounded by the dotted line 43 shows circuitry which utilizes high A.C. voltages as opposed to the other portions of the circuit which utilize digital logic. In FIG. 4, a shift register which is operated by a shift clock, SCK, is comprised of a D type flip flop 21. A latch signal, LP, shown in FIG. 1 is input to the shift clock, SCK. Therefore, the output $D_{n+1}$ is input to the D type flip flop input, Dn, of the next electrode driving circuit in accordance with shift clock, SCK.

In addition, a start pulse, YD, is input to flip flop 21. The output of flip flop 21, $Q_n$ is connected to the inputs I and $\overline{I}$ of the level shifter 23*a* through NOR gate 24 which can force the driver output, OUT, to an equivalent electric level depending on the state of prohibit signal, INH. The outputs O and $\overline{O}$ of the level shifter are connected to the transfer gates 26 and 27 of a co-compensative transistor. In addition, the outputs,O and $\overline{O}$, are connected to the input of the NOR gate 32 and NAND gate 31 respectively. NOR gate 32 and NAND gate 31 are utilized to change the non-selected potential to A.C. The signal which is obtained by combining the frame signal, FR, with prohibit signal, INH, through the NOR gate 36 is input to the other sides of NAND gate 31 and NOR gate 32 through the level shifter 23*b* and an invertor 38. The outputs of NAND gate 31 and NOR gate 32 are connected to a transfer gate 28 of a P channel transistor and a transfer gate 29 of an N channel transistor, respectively to control the output of the non-selected levels $V_1$ and $V_4$.

The selected voltages, $V_0$ and $V_5$ are multiplexed by the transfer gate 40 of the P channel transistor and the transfer gate 41 of the N channel transistor. The output O of the level shifter 23*b* acts as a gate input to each transistor. In addition level shifter 23*b* outputs, O and $\overline{O}$ are also connected to the gates of co-compensative transistors 26 and 27.

When only the output, $Q_n$, of shift register 21 is high, transfer gates 26 and 27 are conductive and the "select" voltage level is transmitted to the output, OUT. When prohibit signal, INH, is high, transfer gates 26 and 27 are conductive, thus the driver output OUT remains high (i.e. $V_5$ or V). Therefore, when the flat display device and thus the driving circuit is ON, and prohibit signal, INH, is high, the outputs of drivers 8, OUT, are at the same voltage level, so that current cannot flow across the electrode and damage the liquid crystal. As a matter of course, the level of the equivalent voltage potential need not be only $V_5$ but can also be $V_0$, $V_1$, $V_4$ or high impedance. Further, it is possible to implement this dual driving circuit for the signal electrodes also.

On the other hand, if the driving method of the present invention has TAB construction wherein a semiconductor IC is used for driving and bonded to flexible tape or COG (Chip On Glass) construction, the driving circuits are connected to both terminals of the liquid crystal cell and are stored easily. In particular, COG construction is superior in that there are wires between the driving circuit and electrodes, and the connecting resistance is kept to a minimum.

Figure 2:
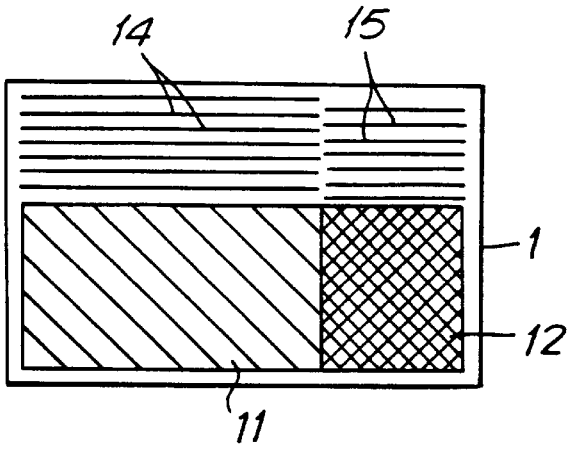
FIG. 2 is perspective view illustrating the problems with the prior art.

Furthermore, even if the driving method of the present invention is only applied to the scanning electrodes, such a construction is effective in preventing the phenomenon shown in FIG. 2. Since the amplitude of the driving voltage of the scanning electrodes is about 5 to 10 times larger than that of the signal electrodes, the delay time during charge and discharge is likely to effect the display quality. This method is most suitable for color liquid crystal cells which have narrow electrode pitches.

In addition, the resistance of the signal electrodes can also be reduced by utilizing thicker transparent electrode films or by coupling a different metal having low resistance to the transparent electrodes, so that the resistance of the scanning electrodes is reduced equivalently. The display quality can be improved in this manner without great cost.

A simple matrix type LCD in the flat display device is explained above. The deterioration of the display quality which may be generated is dependent on the resistance of the display electrodes. This can be improved by the method of the present invention. Therefore, the method of the present invention is widely applicable for active type liquid crystal displays having TFT (thin film transistor) or MIM (metal-insulator-metal), or for flat display till PDP (plasma display panel) wherein much current flows or ELD (electro-luminescence display).

As mentioned above, in accordance with the present invention, since the transparent electrode resistances are reduced to one quarter, this method of driving has the following advantages.

First, in the case of a passive type matrix liquid crystal cell, the voltage applied to a liquid crystal cell approaches a predetermined value which is obtained by the voltage standardizing method. Even if the display device has low or moderate capacitance and is driven by a two-frame A.C. driving method, it is possible to obtain a high contrast display.

Secondly, a large scale panel display having fine pitch can be obtained without deterioration of the display quality.

In addition, since it is not necessary to excessively reduce the output resistance of the driving circuit, it is possible to use an IC having more pins and at a lower cost than those utilized in the prior art.

Finally, since the present invention utilizes thin electrodes, it is possible to obtain flat display panels which are low in cost.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A flat panel liquid crystal display device having a plurality of display picture elements defined by a plurality of essentially parallel scanning electrodes on a first substrate each having first and second terminals on opposite sides thereof and a plurality of essentially parallel signal electrodes on a second opposed substrate each having first and second terminals on opposite sides thereof, the scanning and signal electrodes being arranged to be essentially orthogonal to each other and a liquid crystal material between the substrates, the picture elements defined by intersections of scanning and signal electrodes and rendered visible by a predetermined voltage difference therebetween being arranged in the form of a matrix, comprising first driving circuit means connected to the first terminals of said scanning electrodes and second driving circuit means connected to the second terminals of said scanning electrodes and means for generating control signals applied to said first and second driving circuit means, said first and second driving circuit means being controlled in the same way by the same control signals to simultaneously apply the same driving voltage waveform having essentially the same voltage amplitude to each of the first and second terminals associated with at least one scanning electrode at least when a picture element associated with said at least one scanning electrode is to be rendered visible, whereby essentially the same voltage amplitude is simultaneously applied to each of said first and second terminal associated with at least one scanning electrode to drive said display device element.

2. A flat display device claimed in claim 1, said signal electrodes having first and second terminals on opposite sides thereof further comprising third driving circuit means connected to the first terminals of said signal electrodes and fourth driving circuit means connected to the second terminals of said signal electrodes.

3. A flat display device claimed in claim 2 further including means to generate control signals applied to said third and fourth driving circuit means, said third and fourth driving circuit means being controlled in the same way by the same control signals to simultaneously apply the same driving waveform having essentially the same phase and voltage amplitude to each of the first and second terminals of the signal electrodes.

4. A flat display device claimed in claim 3, wherein said first and second driving circuit means comprise means which receives an inhibit signal representative of power-on from first control signals and forcibly outputs a first predetermined voltage to both terminals of said scanning electrodes, and said third and fourth driving circuit means comprise means which receives an inhibit signal representative of power-on from second control signals and forcibly outputs a second predetermined voltage to both terminals of said scanning electrodes.

5. A flat display device claimed in claim 4, wherein said first driving circuit means comprises first output terminals connected to the first terminals of said scanning electrodes and a first transistor which outputs a predetermined level voltage to said first output terminal, said second driving circuit means comprises second output terminals connected to the second terminals of said scanning electrodes and second transistor means which outputs a predetermined level voltage to said second output terminals, said third driving circuit means comprises third output terminals connected to the first terminals of said signal electrodes and third transistor means which outputs a predetermined level voltage to said third output terminal, and said fourth driving circuit means comprises fourth output terminals connected to the second terminals of said signal electrodes and a fourth transistor means which outputs a predetermined level voltage to said fourth output terminals.

6. A flat display device claimed in claim 1, further comprising means which receives an inhibit signal representative of power-on from said control signals, and forcibly supplies the same predetermined voltage to both terminals of said scanning electrodes for at least the duration of said inhibit signal.

7. A flat display device claimed in claim 1, wherein said first driving circuit means comprises first output terminals connected to said first terminals of said scanning electrodes and first transistor means which outputs a predetermined level voltage to said first output terminal in response to said control signal, and said second driving circuit means comprises second output terminals connected to said second terminals of said scanning electrodes and second transistor means which outputs a predetermined level voltage to said second output terminal in response to said control signal.

8. A flat display device claimed in claim 7 or 5, wherein said display device comprises a liquid crystal display device.

9. A flat display device claimed in claim 8, wherein said scanning electrode and said signal electrodes are transparent.

10. A flat display device claimed in claim 9, wherein said display device comprises a passive matrix type liquid crystal display device.

11. A flat display device having a plurality of display picture elements which are defined by liquid crystal cell portions with a liquid crystal material between a plurality of scanning electrodes and a plurality of signal electrodes arranged in the form of a matrix, each display picture element being rendered visible by a predetermined voltage difference between a scanning electrode and signal electrode, each scanning and signal electrode having a first and second terminals on opposite sides thereof, and including separate scanning driving circuits for simultaneously applying the same driving voltage waveform having essentially the same voltage amplitude to each of said first and second terminals of at least one scanning electrode to drive said display device element.

12. A flat display device claimed in claim 11, including separate scanning driving circuits for each applying equivalent level voltage driving signals applied simultaneously to both of said first and second terminals of each said signal electrodes.

13. A flat display device claimed in claim 12, wherein separate driving signals of the scanning driving circuit are set to the same voltage level to place both of said first and second terminals of said scanning electrodes at the same first level and said separate driving signals of the signal driving circuit are set to the same level to place both terminals of said signal electrodes at the same second voltage level.

14. A flat display device claimed in claim 11, wherein separate driving signals of the scanning driving circuit are set to an equivalent voltage level and both of said first and second terminals of said scanning electrodes are simultaneously placed at the equivalent level for a predetermined period from power-on of said flat display device.

* * * * *